United States Patent [19]

Wiley

[11] Patent Number: 4,976,000

[45] Date of Patent: Dec. 11, 1990

[54] DEVICE ADAPTED FOR CLEANING DUST, GRIME AND THE LIKE FROM A SURFACE SUCH AS A SKYLIGHT

[76] Inventor: Jeffrey D. Wiley, 7625 E. Steele St., Littleton, Colo. 80122

[21] Appl. No.: 353,489

[22] Filed: May 18, 1989

[51] Int. Cl.[5] ..... A47L 1/06; A47L 13/16

[52] U.S. Cl. ..... 15/220 R; 15/210 R

[58] Field of Search ..... 15/209 R, 210 R, 220 R; 131/241

[56] References Cited

U.S. PATENT DOCUMENTS 2,219,974 10/1940 Bellow ..... 131/241

2,956,287 10/1960 Stanford ..... 131/241

FOREIGN PATENT DOCUMENTS 7412697 3/1976 Netherlands ..... 15/220 R

*Primary Examiner*—Edward L. Roberts

[57] ABSTRACT

A device for cleaning dust, grime, and the like from a curved surface such as the interior surface of a skylight window. The device includes a base including a substantially flat, flexible plate and a conical projection extending away from one side of the plate. The distal end of the conical projection is adapted to receive an end of a long pole. The device also includes a pillow filled with polystyrene pellets adapted to be releasably mounted on the side of the plate opposite to the conical projection. The pillow is preferably fashioned of a fabric material suited for removing the dirt and is deformable to a degree such that the shape of the pillow may assume the shape of a curved surface against which the pillow is in forcible contact. The pillow may be releasably attached to the plate by means of hook and loop fasteners. Alternatively, a flexible, removable, interchangeable cover may surround the pillow for the purpose of removing the dirt. When the removable cover is soiled, then a similar, new cover can be placed around the pillow.

25 Claims, 2 Drawing Sheets

DEVICE ADAPTED FOR CLEANING DUST, GRIME AND THE LIKE FROM A SURFACE SUCH AS A SKYLIGHT

BACKGROUND OF THE INVENTION

Skylights are windows fashioned of transparent plastic or glass disposed in the roof of buildings through which light may enter into a room beneath the skylight. In order to strengthen the skylight and to help water and snow run away from the skylight, the plastic or glass is curved in a bubble shape, that is, the skylight window is usually curved outwardly in a convex shape. The interior surface of the skylight is corresponding concave.

The interior surface of skylight windows, just like other windows in a building, often become layered with dust, grime, grease and the like, which often needs to be removed so as to admit more light into the room and to permit a better view through the skylight window. One may clean the interior surface of skylight window by mounting a ladder and using towels, sponges, and similar devices to remove the dirt. Obviously, this cleaning procedure is laborious and perilous. Alternatively, the skylight window may be cleaned by manipulation of a cleaning device mounted on the end of a long, extended pole or handle. The cleaning device requires a certain degree of rigidity in order to provide a scrubbing action against the interior surface of the skylight window and also needs to be a deformable in order to adapt to the contours of the skylight window.

The present invention provides a safe, effective device for cleaning dirt from the interior surface of a skylight window, although the device may be safely and effectively used for cleaning other surfaces too.

SUMMARY OF THE INVENTION

The present invention relates to a device for cleaning dust, grime, and the like from a curved surface such as the interior surface of a skylight window. The device includes a base including a substantially flat, flexible plate and a conical projection extending away from one side of the plate. The distal end of the conical projection is adapted to receive an end of a long pole. The device also includes a pillow filled with polystyrene pellets adapted to be releasably mounted on the side of the plate opposite to the conical projection. The pillow is preferably fashioned of a fabric material suited for removing the dirt and is deformable to a degree such that the shape of the pillow may assume the shape of a curved surface against which the pillow is in forcible contact. The pillow may be releasably attached to the plate by means of hook and loop fasteners. Alternatively, a flexible, removable, interchangeable cover may surround the pillow for the purpose of removing the dirt. When the removable cover is soiled, then a similar, new cover can be placed around the pillow.

BRIEF DESCRIPTION OF THE DRAWINGS

The present invention will be described with reference to the accompanying drawings, wherein.

BRIEF DESCRIPTION OF A PREFERRED EMBODIMENT

Figure 1:
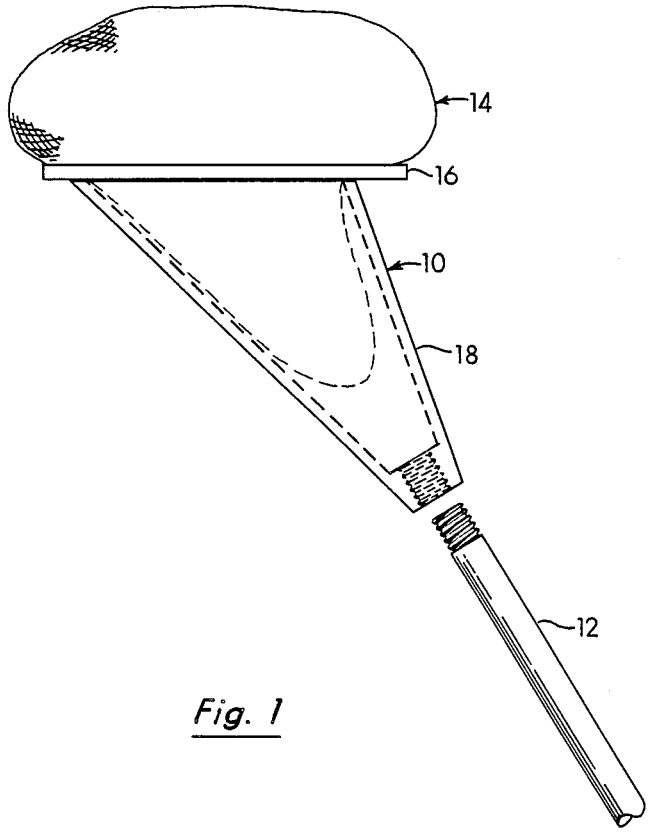
FIG. 1 is a side view of a cleaning device in accordance with one embodiment of the present invention.

The present invention will be described with reference to the accompanying drawings wherein like reference numerals refer to the same item.

There is shown in FIG. 1 a cleaning device in accordance with one embodiment of the present invention. The cleaning device includes a base 10, a relatively long pole 12, and a pouch or pillow 14.

Figure 2:
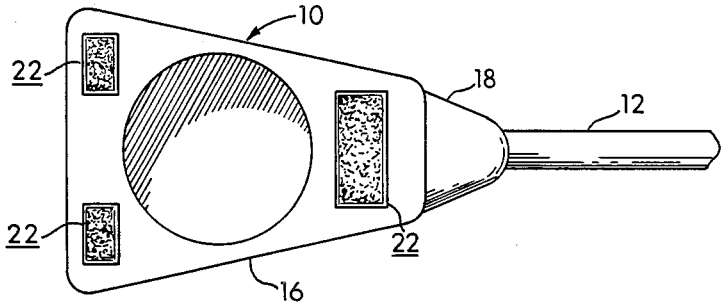
FIG. 2 is a top view of the base portion of the cleaning device and the pole of the cleaning device show in FIG. 1.

The base 10 includes a substantially flat plate 16 fashioned of a slightly flexible, non-abrasive material. The base 10 further includes a conical projection 18 extending away from one side of the plate 16 at an angle in the range between thirty to seventy-five degrees, and preferably at an angle of about fifty degrees. The conical projection 18 is hollow and joins the plate 16 around the periphery of a hole in the plate 16, as best shown in FIG. 2. The distal end of the conical projection 18 is adapted to receive the end of the pole 12, and preferably is threaded to receive the threaded end of the pole 12, as shown in FIG. 1, so that the pole 12 is readily detachable from the base 10.

Figure 3:
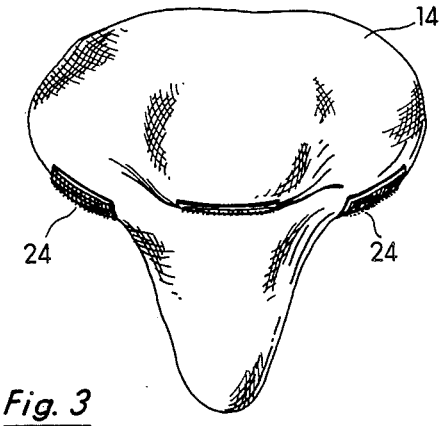
FIG. 3 is a side view of a pillow of the cleaning device shown in FIG. 1.
Figure 4:
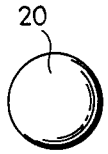
FIG. 4 is a side view of one of the several pellets contained within the pillow shown in FIG. 3.

The pillow 14 is fashioned generally in the shape of a mushroom, as best shown in FIG. 3. The pillow 14 is preferably fashioned of a flexible fabric material and may be formed by stitching the fabric to create the mushroom configuration. The pillow 14 contains a plurality of polystyrene pellets 20, one of which is shown in FIG. 4. Each pellet 20 preferably possesses a volume in the range of one cubic centimeter to twelve cubic centimeters and has a mass of about two grams. The pouch 14 contains a total of between forty and one thousand pellets 20 and possesses a total volume of about five hundred cubic inches and a weight of less than about five ounces.

Figure 5:
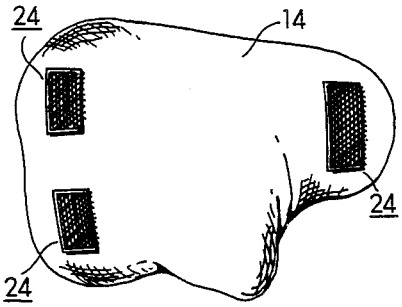
FIG. 5 is a bottom view of the pillow shown in FIG. 3.

The plate 16 possesses three hook portions 22 of a loop and hook fastener (such as a VELCRO fastener) secured by means of adhesive or the like on the side opposite the conical projection 18, as best shown in FIG. 2. The pillow 14 possesses a corresponding number and arrangement of loop portions 24 of a loop and hook fastener, as best shown in FIGS. 3 and 5. Thus, the pillow 14 may be releasably attached to the plate 16, with the lower end of the mushroom shaped pillow 14 depending within the interior of the hollow conical projection 18. As shown in FIGS. 2 and 5, the configuration of the top of the pillow 14 generally corresponds with the configuration of the plate 16, although the top of the pillow 14 may be effectively used in other configurations too.

Since the pellets 20 do not totally fill and stuff the pillow 14, the pellets 20 are in a somewhat fluid, loose, and non-ordered state such that the shape of the peripheral surface of the pillow is deformable. It will be appreciated that when the cleaning device shown in FIG. 1 is used to clean a surface, especially a curved surface, the pillow 14 will deform so that the pillow 14 is in intimate contact with the surface over a substantial area of the pillow 14. Also, it will be appreciated that the polystyrene pellets 20 are non-compressible so that the pillow 14 is also non-compressible. The extension of the bottom portion of the mushroom shaped pillow 14 into the hollow interior of the conical projection 18 helps achieve a large degree of deformability while at the same time preserving a high degree of non-compressibility. Also the bottom portion of the mushroom shaped pillow 14 helps prevent the pillow 14 from sliding away from and becoming disattached from the plate 16 when the pillow 14 is forcefully moved along the skylight window or other surface.

The angle of the conical projection 18 and pole 12 relative to the plate 16 helps one to apply a force against the pillow 14 in both an upward and a sideways direction so that the pillow 14 is maintained in forceful contact with the skylight window and still can be moved along the window. The plate 16 is somewhat flexible and non-abrasive so that the plate 16 also may conform to the contours of the window and will not scratch the window or mar the edging around the window. Moreover, the plate 16 is triangularly shaped so as to permit better cleaning in the corners of the window. Although the device is especially adapted for cleaning curved surfaces, the device may also be effectively used for cleaning flat surfaces too.

Figure 6:
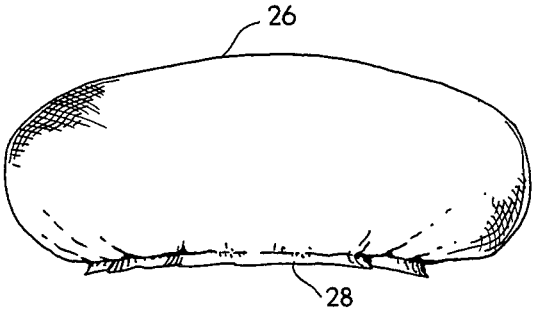
FIG. 6 is a side view of a cover adapted to surround the upper portion of the pillow shown in FIG. 3.
Figure 7:
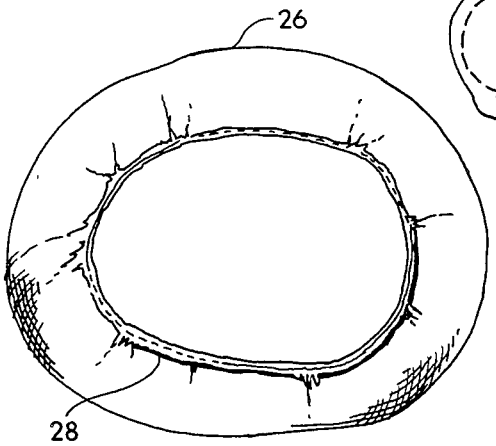
FIG. 7 is a bottom view of the cover shown in FIG. 6.
Figure 8:
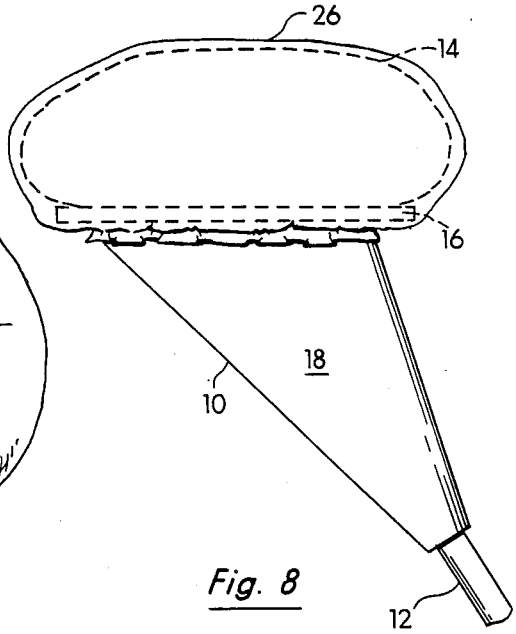
FIG. 8 is a side view of the cleaning device shown in FIG. with the cover shown in FIGS. 6 and 7.

It is contemplated that the pouch 14 may be disposable and replaced with a similar pouch 14, or that the fabric forming the pouch 14 may be replaced. Alternatively, a disposable cover 26 may be advantageously used with a cleaning device shown in FIG. 1. As best shown in FIGS. 6 and 7, the replaceable cover 26 is fashioned in the shape of a cap having a lower, generally circular opening. The cover 26 is preferably fashioned of a flexible, fabric material and includes an elastic band 28 surrounding the peripheral edge of the opening. The elastic band 28 biases the opening toward a relatively small size. As best shown in FIG. 8, the cover 26 is adapted to surround the upper portion of the pillow 14 and the peripheral edge of the plate 16, which forms a lip below which the elastic band 28 snugly surrounds the peripheral edge of the conical projection 18.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than as specifically described above.

I claim:

1. A device adapted for cleaning dust, grime and the like from a surface comprising:

a base;

a plurality of pellets;

a flexible pouch enclosing said pellets in a loose and non-ordered state such that the shape of the peripheral surface of said pouch is deformable;

means for attaching said pouch to said base;

a flexible, removable cover adapted to surround at least a portion of said pouch; and means for selectively maintaining said cover in a condition of surrounding at least a portion of said pouch.

2. A cleaning device according to claim 1 wherein said pellets are each substantially non-compressible.

3. A cleaning device according to claim 1 wherein said pellets are fashioned substantially entirely from polystyrene.

4. A cleaning device according to claim 1 wherein said pellets each possess a volume substantially in the range of one cubic centimeter to twelve cubic centimeters.

5. A cleaning device according to claim 1 wherein said pellets each possess a mass of less than about two grams.

6. A cleaning device according to claim 1 wherein said pouch possesses a volume of less than about one thousand cubic inches and a weight of less than about ten ounces.

7. A cleaning device according to claim 1 wherein the number of said pellets is substantially within the range of between forty and one thousand.

8. A cleaning device according to claim 1 wherein said cover is fashioned substantially of fabric.

9. A cleaning device according to claim 1 wherein said cover possesses an opening, and wherein said cover includes an elastic band extending substantially around the peripheral edge of the opening, whereby the size of the opening may be varied and whereby the opening is biased toward a relatively small size.

10. A cleaning device according to claim 9 wherein said base includes a substantially flat portion and wherein said cover is adapted to surround at least a portion of said flat portion.

11. A cleaning device according to claim 1 wherein said attaching means includes at least one set of hook and loop type fasteners for releasably attaching said pouch to said base.

12. A cleaning device according to claim 1 wherein said base includes a substantially flat plate portion and a substantially conical projection extending substantially from the central region of said plate such that the distal end of said conical projection away from said base is the smaller end of said conical projection.

13. A cleaning device according to claim 11 wherein said conical projection is hollow and wherein said pouch is adapted to rest upon said plate and within at least a portion of the interior of said conical projection.

14. A cleaning device according to claim 12 wherein said conical projection extends at an angle relative to said plate substantially in the range of between thirty to seventy-five degrees.

15. A cleaning device according to claim 12 wherein the distal end of said conical projection possesses a configuration adapted to receive an end of a pole.

16. A cleaning device according to claim 12 wherein said plate is flexible.

17. A device for cleaning dust, grime and the like from a curved surface comprising:

a base including a substantially flat plate and a projection extending away from one side of said plate, said projection adapted to receive an end of a pole;

a pillow mounted on said plate on the side of said plate opposite to said extension, said pillow being deformable to a degree such that the shape of the peripheral surface of said pouch may be modified to assume the shape of either a convex or concave surface against which said pillow is in forceful contact;

means for releasably attaching said pillow to said plate; and a flexible, removable cover adapted to surround at least a portion of said pillow, said covering being substantially bulbous shaped and possessing an opening, and said covering including an elastic band extending substantially around the peripheral edge of the opening, whereby the size of the opening may be varied and whereby the opening is biased toward a relatively small size.

18. A device adapted for cleaning dust, grime and the like from a surface comprising:

a base;

a plurality of pellets;

a flexible pouch enclosing said pellets in a loose and non-ordered state such that the shape of the peripheral surface of said pouch is deformable; and at least one set of hook and loop type fasteners for releasably attaching said pouch to said base.

19. A cleaning device according to claim 18 wherein said base includes a substantially flat plate portion and a substantially conical projection extending substantially from the central region of said plate such that the distal end of said conical projection away from said base is the smaller end of said conical projection.

20. A cleaning device according to claim 19 wherein said conical projection is hollow and wherein said pouch is adapted to rest upon said plate and within at least a portion of the interior of said conical projection.

21. A cleaning device according to claim 20 wherein said conical projection extends at an angle relative to said plate substantially in the range of between thirty to seventy-five degrees.

22. A cleaning device according to claim 20 wherein the distal end of said conical projection possesses a configuration adapted to receive an end of a pole.

23. A device adapted for cleaning dust, grime and the like from a surface comprising:

a base including a substantially flat plate portion and a substantially hollow, conical projection extending substantially from the central region of said plate portion such that the distal end of said conical projection away from said base is the smaller end of said conical projection;

a plurality of pellets;

a flexible pouch enclosing said pellets in a loose and non-ordered state such that the shape of the peripheral surface of said pouch is deformable, said pouch being adapted to rest upon said plate portion and within at least a portion of the interior of said conical projection; and means for attaching said pouch to said base.

24. A cleaning device according to claim 23 wherein said conical projection extends at an angle relative to said plate substantially in the range of between thirty to seventy-five degrees.

25. A cleaning device according to claim 23 wherein the distal end of said conical projection possesses a configuration adapted to receive an end of a pole.

* * * * *